US006742505B2

(12) United States Patent
Liskow

(10) Patent No.: US 6,742,505 B2
(45) Date of Patent: Jun. 1, 2004

(54) INTERNAL COMBUSTION ENGINE AND METHOD, COMPUTER PROGRAM AND CONTROL APPARATUS FOR OPERATING THE INTERNAL COMBUSTION ENGINE

(75) Inventor: Uwe Liskow, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/267,653

(22) Filed: Oct. 10, 2002

(65) Prior Publication Data

US 2003/0066516 A1 Apr. 10, 2003

(30) Foreign Application Priority Data

Oct. 10, 2001 (DE) ..... 101 49 960

(51) Int. Cl.[7] ..... F02M 33/04; F02D 41/20

(52) U.S. Cl. ..... 123/480; 123/486; 123/498; 701/115; 310/311

(58) Field of Search ..... 701/105, 115; 123/472, 480, 486, 490, 498; 239/585.1; 310/311, 316.01, 317, 318

(56) References Cited

U.S. PATENT DOCUMENTS 5,130,598 A * 7/1992 Verheyen et al. ..... 310/316.03
6,328,019 B1 * 12/2001 Janker ..... 123/498
6,340,858 B1 * 1/2002 Jaenker ..... 310/328
6,486,587 B2 * 11/2002 Klenk et al. ..... 310/316.03
2003/0062027 A1 * 4/2003 Joos et al. ..... 123/478

FOREIGN PATENT DOCUMENTS

DE 198 48 950 4/2000

* cited by examiner

*Primary Examiner*—Hieu T. Vo
*Assistant Examiner*—Hai Huynh
(74) *Attorney, Agent, or Firm*—Walter Ottesen

(57) ABSTRACT

In an internal combustion engine, the fuel reaches a combustion chamber via at least one fuel-injecting device. The fuel-injecting device includes a piezo actuator. The drive energy (U), which is necessary for a specific stroke (h) of the piezo actuator, is determined from at least one function (34 to 40) which couples the stroke (h), the drive energy (U) and the drive time (t) of the piezo actuator with each other. In order to more accurately adjust the stroke of the piezo actuator, it is suggested that a function (34 to 40) be used for the determination of the drive energy (U). These functions (34 to 40) were previously determined for a typical collective load (L1, L2) to which a piezo actuator is subjected.

13 Claims, 3 Drawing Sheets

INTERNAL COMBUSTION ENGINE AND METHOD, COMPUTER PROGRAM AND CONTROL APPARATUS FOR OPERATING THE INTERNAL COMBUSTION ENGINE

FIELD OF THE INVENTION

The invention relates to a method for operating an internal combustion engine wherein the fuel reaches at least one combustion chamber via at least one fuel-injecting device which includes a piezo actuator. In the method, the drive energy, which is required for a specific stroke of the piezo actuator, is determined from at least one function which couples the stroke, the drive energy and the operating time of the piezo actuator to each other.

BACKGROUND OF THE INVENTION

Such a method is disclosed in U.S. Pat. No. 6,328,019 (corresponds to German patent publication 198 48 950). Here, an internal combustion engine is operated with fuel injection valves which include piezoelectric actuators. These actuators, in turn, include a piezo stack, which is changeable in length under the action of an electric control voltage and operates on a valve member. The change of length is longer or shorter depending upon the magnitude of the control voltage. The relationship between the length change (stroke) and the control voltage is, however, dependent upon deterioration. For this reason, the suggestion is made in U.S. Pat. No. 6,328,019 to compensate the effects of deterioration of the piezo actuator via a sensor detection of the duration of operation measured in hours.

For this purpose, sensors detect the instantaneous use and operating conditions of the engine in which the fuel injection valve having the piezo actuator is utilized and, in dependence upon the signals of the sensors, a computer supported parameterization of the course of expansion is carried out. In summary, a function is formed which couples the stroke, the drive energy and the operating time of the piezo actuator to each other.

These measures function to meter the fuel quantity which is intended to reach the combustion chamber of the engine with the greatest possible accuracy. The fuel quantity flow which exits through the fuel-injecting device is influenced, inter alia, by the stroke of the piezo actuator. A precise metering of the fuel in an injection makes possible an optimization of the emission performance of the engine and of the consumption of fuel.

Notwithstanding the provided measures, it was, however, determined that the emission performance and the fuel consumption of the engine deteriorate over the service life of the engine.

SUMMARY OF THE INVENTION

It is an object of the invention to improve a method mentioned initially herein so that the emission performance and the fuel consumption are optimal during a longest possible duration of operation of the engine.

The method of the invention is for operating an internal combustion engine wherein fuel reaches a combustion chamber of the engine via a fuel injection device which includes a piezo actuator operating over a running or operating time (t) and for which a drive energy (U) is required for a specific stroke (h). The method includes the steps of: determining a function which couples the stroke (h), the drive energy (U) and the operating time (t) for a typical collective load (L1, L2) to which a piezo actuator can be subjected; and, utilizing the function to determine the required drive energy (U) for the specific stroke (h).

According to the invention, it has been determined that the characteristic line of a piezo actuator, that is, the interrelationship between the drive energy and the stroke is not only dependent upon the operating time (time span, number of actuations, et cetera) but also on the collective load to which the piezo actuator is subjected. Under the term "collective load", the trace of at least an external load is understood to which the piezo actuator can be subjected. If, throughout its service life, only low external loads act on a piezo actuator, then, after a specific operating time, another drive energy is required in order to effect a specific stroke of the piezo actuator than in the case in which comparatively large loads act on the piezo actuator during the elapsed time span.

The typical collective loads are known for most applications of the fuel-injecting device, that is, of the piezo actuator built thereinto. If the collective load, which is typical for the specific use, is also considered in the determination of the function which couples the stroke, the drive energy and the operating time to each other, then one obtains a function with which one can determine the drive energy, which is required for a specific stroke of the piezo actuator, in dependence upon the operating time with very high precision. This function is then for the specific use of the fuel-injecting device, that is, the piezo actuator.

In this way, it is ensured that the fuel reaches the combustion chambers of the engine with high precision over the entire service duration of the piezo actuator and of the fuel-injecting device. In this way, the advantage of the invention of an optimization of the emission performance and of a reduction of the fuel consumption is achieved for engines operated in this way. It is understood that the invention can be applied equally to gasoline engines and diesel engines as well as to internal combustion engines having intake manifold injection or direct injection.

In a first embodiment, it is suggested that the collective load is typical for the use of a piezo actuator in a specific internal combustion engine and/or for the use of an engine under specific conditions. Accordingly, the typical collective loads are different, for example, for engines having different numbers of cylinders and/or with different arrangements of the cylinders. The collective loads of diesel engines are different than gasoline engines. Also, the way the fuel-injecting device is mounted on the engine block of the engine has an effect on the collective load.

Furthermore, collective loads are distinguished from each other depending upon whether the engine is utilized, for example, in a passenger automobile or in a truck or a locomotive or in an aircraft. Also the following can have effects on the typical collective load: the area of use and the corresponding road conditions; a chassis of a vehicle in which the engine is mounted; or the nature of the motor vehicle (especially sports car or limousine). The differentiation suggested here increases again the precision with which the fuel reaches the combustion chambers of the engine.

It is also possible that a plurality of functions is present. The functions apply for different collective loads and an actual collective load is determined by means of sensors during operation of the engine and, based on this actual collective load, that function is selected from the plurality of functions whose collective load is closest to the actual collective load. In this further improvement, one can react flexibly to a deviation of the actual collective load from the originally assumed collective load. In this way, always that function is available for the computation of the drive energy, which is needed for a specific stroke, during the entire service life of the engine. With this function, the effects of deterioration of the piezo actuator are considered in the best possible manner while considering the actual collective load to which the piezo actuator was subjected. Here too, the emission performance of the engine is improved and the fuel consumption reduced.

It is especially advantageous when the collective load includes a typical trace of the temperature of the piezo actuator and/or a typical trace of a drive time of the piezo actuator and/or a typical trace of accelerations to which the piezo actuator is subjected. Such collective loads include those parameters which have the largest effects on the deterioration characteristic of the piezo actuator. If a function is used for the determination of the drive energy, which initially had been determined for a collective load of this kind, then the deterioration characteristic of the piezo actuator is very accurately reflected.

In an advantageous configuration of the invention, it is suggested that a function be used, which was set up for at least a standard stroke of a piezo actuator, and that the drive energies for the strokes of the piezo actuator be derived from this function, which deviate from the at least one standard stroke. This can, for example, take place via corresponding reduction factors. In this way, storage space and computation time is saved which operates favorably on the cost in the realization of the engine.

It is also possible that the function includes a characteristic field specific for a collective load into which the desired stroke and the operating time is fed in and which outputs the needed drive energy therefor. This requires more storage space and possibly also more computation time but increases the precision of the determination of the drive energy needed for a specific stroke.

It is especially advantageous in the method of the invention when the functions were determined empirically. For this purpose, an internal combustion engine can be mounted on a test stand with the engine being equipped with a fuel-injecting device having a piezo actuator. During the operation of the engine, the engine is subjected to different external loads and to different courses of the load. However, it is also possible to mount the piezo actuator directly, for example, on a device for generating vibrations and to record the deterioration characteristic of the piezo actuator for a specific trace or course of the external loads. For another course of the external loads, the same experiment must be carried out with a new piezo actuator.

The result of the empirical determination of the function then provides more information when the piezo actuator, which is used to empirically determine the function, is first predeteriorated. In this way, the same start conditions are provided for the piezo actuators, which improves the result and therefore leads to a still better metering of the fuel into the combustion chambers of the engine when utilizing the function.

The invention also relates to a computer program, which is suitable for carrying out the above method when it is executed on a computer. Here, it is especially preferred when the computer program is stored on a memory, especially on a flash memory.

The invention also relates to a control apparatus (open loop and/or closed loop) for operating internal combustion engines. In order to optimize the emission performance of the engine and to reduce fuel consumption, it is suggested that the control apparatus include a memory on which a computer program of the above kind is stored.

The subject matter of the invention is also an internal combustion engine with at least one fuel-injecting device via which the fuel reaches at least one combustion chamber and which includes a piezo actuator and includes a control apparatus, which determines the drive energy, which is needed for a specific stroke of the piezo actuator, from at least one function which couples the stroke, the drive energy and the operating time of the piezo actuator with each other.

In order to improve the emission characteristic of the engine and to reduce the fuel consumption, it is suggested that the control apparatus determine the drive energy by means of a function which was determined initially for a typical collective load to which the piezo actuator can be subjected.

It is especially advantageous when the internal combustion engine includes a control apparatus of the above kind.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
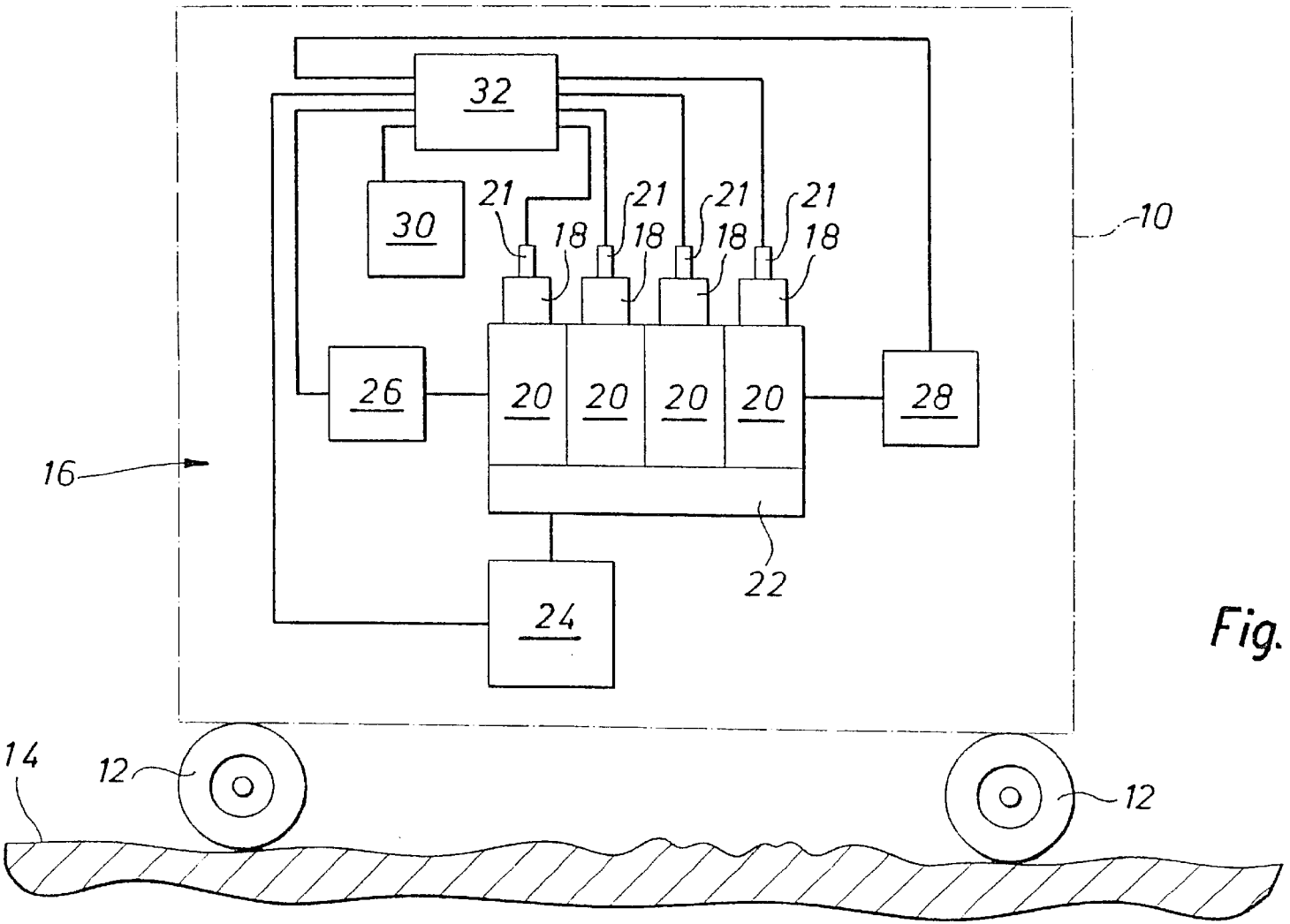
FIG. 1 is a schematic of an internal combustion engine having several fuel-injecting devices which include respective piezo actuators, with the engine being built into a motor vehicle.

In FIG. 1, reference numeral 10 identifies a motor vehicle. The motor vehicle 10 is shown only symbolically by a dot-dash line and is connected via wheels 12 to a roadway 14. The motor vehicle 10 is driven by an internal combustion engine 16. The engine here is a gasoline direct injection engine. This means that the fuel is injected directly by injectors 18 into the combustion chambers 20. The injectors 18 include piezo actuators 21. With a combustion of fuel in the combustion chambers 20, a rotation is imparted to a crankshaft 22, which drives at least one of the wheels 12 via a transmission (not shown).

The rpm of the crankshaft 22 is detected by an rpm sensor 24. The temperature of the engine 16 is detected by a temperature sensor 26. Accelerations, which are caused by vibrations of the engine 16, are picked up by an acceleration sensor 28. A time unit 30 is provided which detects the entire time during which the engine 16 is in operation. The rpm sensor 24, the temperature sensor 26, the acceleration sensor 28 and the time unit 30 send corresponding signals to a control apparatus 32, which, in turn, drives the piezo actuators 21 of the injectors 18.

The piezo actuators 21 operate on valve members (not shown), which clear outlet openings (not shown) at the combustion chamber end of the injectors 18 or close the same. Depending upon the stroke executed by a valve member, more or less fuel reaches the corresponding combustion chamber 20 during an injection. To keep the fuel consumption as low as possible and to generate the least possible emissions during the operation of the engine, it is necessary that the fuel be metered to the individual combustion chambers 20 with the highest possible accuracy.

For this purpose, it is necessary to be able to adjust the stroke of the valve member or of the piezo actuator 21 connected thereto with the greatest accuracy. The stroke of a piezo actuator 21 is, in turn, dependent upon the drive voltage which is applied to the piezo actuator 21. For a low drive voltage, the stroke is correspondingly less than for a larger drive voltage. The ratio between the drive voltage U and the stroke (h) of the piezo actuator 21 changes, however, as a function of the operating time (t) of the piezo actuator 21. The nature of the change is dependent upon the external loads to which the piezo actuator 21 is subjected during operation of the engine 16 or of the motor vehicle 10. In order to consider these interrelationships, one proceeds as described hereinafter.

Figure 2:
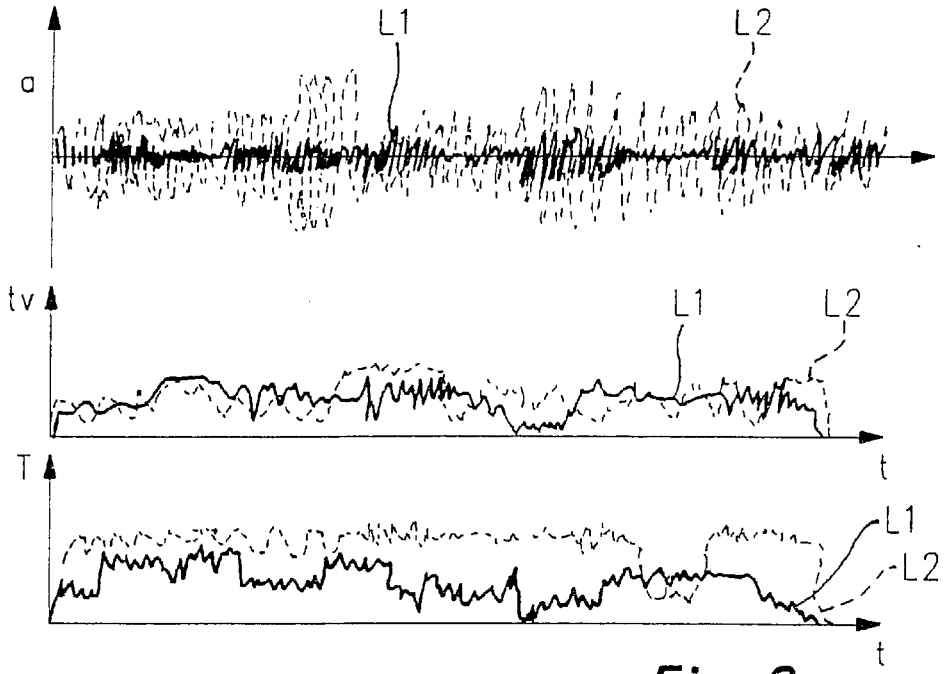
FIG. 2 shows two collective loads, which include a temperature, a drive time and an acceleration to which a piezo actuator is subjected in order to determine two functions which couple the drive energy and the operating time of such a piezo actuator for this collective load.

First, a piezo actuator of that type is installed on a test stand (not shown) which is built into the injectors 18 of the engine 16. The piezo actuator has previously been predeteriorated. The test stand is so configured that, in a prolonged test, such voltage pulses can be applied to the piezo actuator at the frequency usual in a normal operation of the engine 16 that a specific stroke (h1) results. During the drive of the piezo actuator, external loads operate thereon which, in total, form a collective load L1 (see FIG. 2). These external loads are: a trace of the temperature T, a trace of the accelerations (a) and a trace of the mean effective drive times (tv) of the piezo actuator. These traces, which form the collective load L1, correspond to such traces as occur typically for four-cylinder engines having gasoline direct injection, which are used in sedans, which, in turn, are most often driven by a normal driver.

Figure 3:
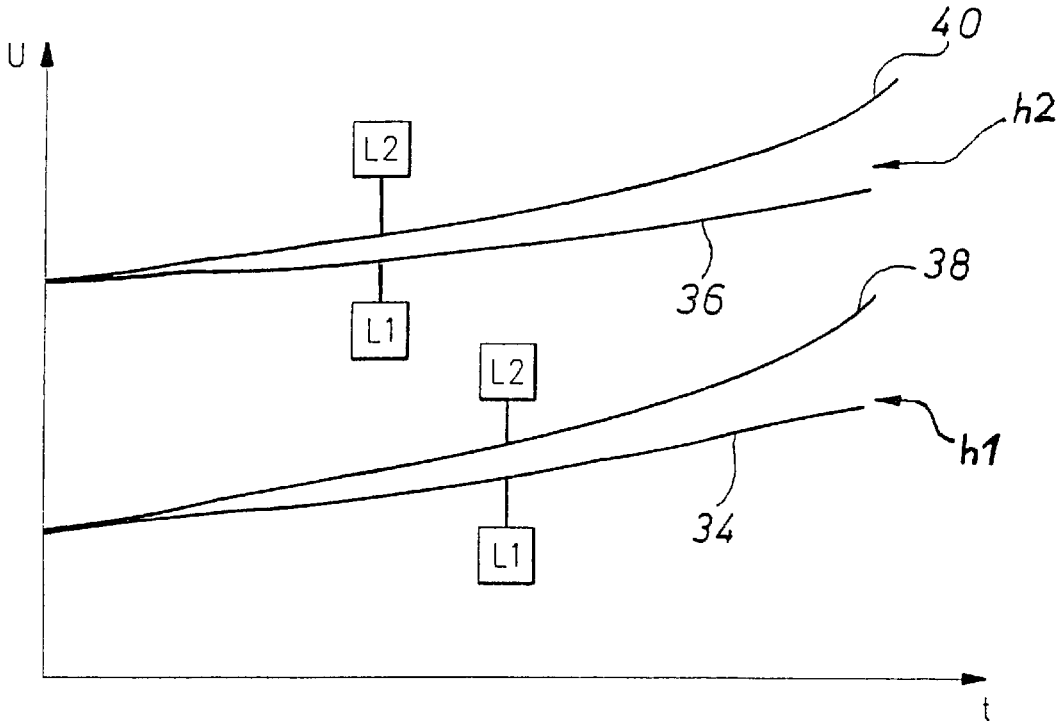
FIG. 3 is a diagram wherein the drive energies are shown for a first and a second stroke of the piezo actuator of FIG. 1 plotted as a function of the operating time and dependent upon the collective loads of FIG. 2; and, FIG. 4 is a diagram showing two characteristic fields for two collective loads of FIG. 2, which couple stroke, drive energy and operating time of a piezo actuator with each other.

In the course of the test time (t), the piezo actuator deteriorates so that the drive voltage U must be increased in order to maintain the stroke (h1). From this, the function, which is identified in FIG. 3 by reference numeral 4, results via which the drive voltage U, the stroke (h1) and the operating time (t) for the specific and typical collective load L1 are coupled to each other. An experiment is carried out with the same collective load L1 with another, likewise predeteriorated piezo actuator, which likewise corresponds to the type in use in the engine 16 and, in this test, such a drive voltage is applied to the piezo actuator that a stroke (h2) results. The result of this test is a function which is identified by reference numeral 36 is FIG. 3.

A similar experiment as with the previous piezo actuators is carried out on the test stand with a further, predeteriorated piezo actuator of the type which is used in the engine 16. The drive of the piezo actuator takes place so that the stroke (h1) again results. The collective load, which acts on the piezo actuator, is however different. This collective load is identified by L2 in FIG. 2. As a test result, one obtains the function curve identified by reference numeral 38 in FIG. 3. With a further piezo actuator, the same test is carried out at the stroke (h2) which leads to the function curve 40 in FIG. 3. The collective load L2 corresponds basically to the collective load L1 but it is assumed that the driver of the vehicle 10 drives in a more "sporty" manner so that greater accelerations, a higher temperature and greater differences in the average effective drive times of the piezo actuator occur.

The function graphs 34, 36, 38 and 40 are stored in the control apparatus 32. As a standard, it is assumed that the motor vehicle 10 is used by a normal driver. The drive energy U, which is necessary for a specific stroke (h), is therefore first determined in a standard manner on the basis of the curves 34 and 36, which apply to the collective load L1. The drive energies U for the strokes, which deviate from the strokes (h1) and (h2), are determined by linear interpolation or by linear extrapolation. Depending upon the operating time, which is determined by the time unit 30 of the engine 16, a drive voltage U results in the determination of which the deterioration characteristic of the piezo actuator 21 is considered. This deterioration characteristic is dependent upon the specific collective load L1.

During the operation of the motor vehicle 10 and the engine 16, the signals of the rpm sensor 24, the temperature sensor 26 and the acceleration sensor 28 are also evaluated. From these signals, an actual collective load is determined to which the piezo actuators 21 were subjected during the operation of the engine 16. This collective load is compared to the collective loads L1 and L2 stored likewise in the control apparatus 32. If this comparison shows that the actual collective load, which had been determined by the sensors 24 to 28, corresponds more closely to the collective load L2, then the determination of the drive energy U, which is necessary for the determination of the stroke (h), applies in the future on the basis of the curves 38 and 40 which apply to the collective load L2.

The comparison of the actual collective load to the collective loads L1 and L2, which were initially determined and are stored in the control apparatus 32, can take place at regular intervals. In this way, it can, for example, be considered when a long-term change of the driving style occurs because of a change of the owners of the motor vehicle 10. The standard use of the function graphs 34 and 36, which are based on the collective load L1, improves already considerably the precision in the determination of the drive energy U needed for a specific stroke (h) because unchanging quantities are already considered for the collective load L1 for the loads acting on the piezo actuators 21. These unchanging quantities include, for example, the number of cylinders of the engine 16, the type of vehicle 10, et cetera. With the possibility to change from collective load L1 to collective load L2 and vice versa, also such quantities can be considered which influence the deterioration characteristic of the piezo actuator 21, but which can change during the service life of the engine 16 or of the vehicle 10.

Figure 4:
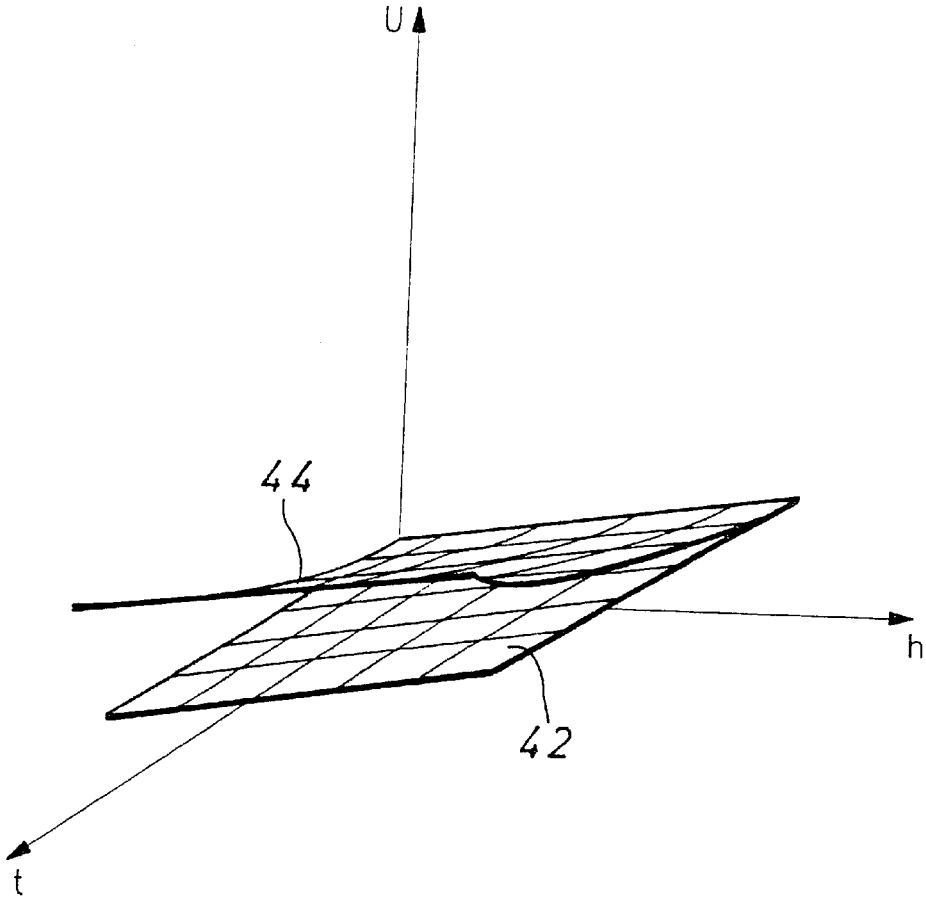

In lieu of the function graphs 34, 36, 38 and 40, also various characteristic fields can be stored in the control apparatus 32. Here, for each collective load, its own characteristic field can be stored and this is shown in FIG. 4. Into the characteristic fields, which are identified in FIG. 4 by reference numerals 42 and 44, the wanted stroke (h) and the elapsed operating time (t) can be fed. One then obtains the drive energy U required for the stroke (h) at the output of each characteristic field 42 and 44. Here too, it is possible, depending upon the actual collective load, which was detected by the sensors 24 to 28 of the engine 16, to change from characteristic field 42 to characteristic field 44 and vice versa.

In the above embodiments, always a real time value is understood under the term "operating time", which is expressed, for example, in hours. It is also possible to use a value for the operating time, which results from the number of actuations of the injectors 18 or of the piezo actuators 21. If required, for such a value, the average stroke can also be considered which is developed by the piezo actuator 21. It can also be considered which ambient conditions (temperature, pressure, et cetera) are actually present in the determination of the drive voltage U, which is required for a specific stroke (h), from the function graphs 34 to 40 or from one of the characteristic fields 42 or 44. These parameters too can influence the relationship between the stroke (h) and the drive voltage U required therefor.

It is understood that the foregoing description is that of the preferred embodiments of the invention and that various changes and modifications may be made thereto without departing from the spirit and scope of the invention as defined in the appended claims.

What is claimed is:

1. A method for operating an internal combustion engine wherein fuel reaches a combustion chamber of said engine via a fuel injection device which includes a piezo actuator operating over a running or operating time (t) and for which a drive energy (U) is required for a specific stroke (h), the method comprising the steps of:

determining a function which couples said stroke (h), said drive energy (U) and said operating time (t) for a typical collective load (L1, L2) to which a piezo actuator can be subjected; and, utilizing said function to determine said required drive energy (U) for said specific stroke (h).

2. The method of claim 1, wherein said collective load (L1, L2) is typical for the use of a piezo actuator in at least one of the following: a specific internal combustion engine and for the use of an internal combustion engine under specific conditions.

3. The method of claim 1, wherein there are a plurality of said functions which apply for different collective loads (L1, L2); and, wherein said method comprises:

determining an actual collective load during operation of said engine utilizing sensors; and, based on said actual collective load, selecting that function from said plurality of functions whose collective load (L1, L2) is closest to said actual collective load.

4. The method of claim 1, wherein said collective load (L1, L2) includes at least one of the following to which a piezo actuator is subjected: a typical trace of the temperature (T) of said piezo actuator, a typical trace of a drive time (tv) of a piezo actuator and a typical trace of accelerations (a).

5. The method of claim 1, wherein a function is used which was prepared for at least one standard stroke (h1, h2) of a piezo actuator; and, from this function, the drive energy (U) for strokes (h) of the piezo actuator is derived and which strokes (h) deviate from said at least one standard stroke (h1, h2).

6. The method of claim 1, wherein said function includes a characteristic field specific for a collective load (L1, L2) into which the wanted stroke (h) and the operating time (t) are fed and which outputs the needed drive energy (U) therefor.

7. The method of claim 1, wherein said function is determined empirically.

8. The method of claim 7, wherein the piezo actuator, which is used for an empirical determination of a function, is first predeteriorated.

9. A computer program comprising a method which can be carried out when said computer program is run on a computer, the method being for operating an internal combustion engine wherein fuel reaches a combustion chamber of said engine via a fuel injection device which includes a piezo actuator operating over a running or operating time (t) and for which a drive energy (U) is required for a specific stroke (h), the method comprising the steps of:

determining a function which couples said stroke (h), said drive energy (U) and said operating time (t) for a typical collective load (L1, L2) to which a piezo actuator can be subjected; and, utilizing said function to determine said required drive energy (U) for said specific stroke (h).

10. The computer program of claim 9, wherein said computer program is stored on a memory including on a flash memory.

11. A control apparatus for operating an internal combustion engine, the control apparatus comprising: a memory storing a computer program for carrying out a method for operating an internal combustion engine wherein fuel reaches a combustion chamber of said engine via a fuel injection device which includes a piezo actuator operating over a running or operating time (t) and for which a drive energy (U) is required for a specific stroke (h), the method comprising the steps of:

determining a function which couples said stroke (h), said drive energy (U) and said operating time (t) for a typical collective load (L1, L2) to which a piezo actuator can be subjected; and, utilizing said function to determine said required drive energy (U) for said specific stroke (h).

12. An internal combustion engine comprising:

a combustion chamber;

an injection device via which fuel reaches said combustion chamber and said injection device including a piezo actuator;

a control apparatus including means for determining a drive energy (U) required for a specific stroke (h) of said piezo actuator from at least a function which couples said stroke (h), the drive energy (U) and the operating time (t) and which had been determined for a typical collective load (L1, L2) to which a piezo actuator can be subjected.

13. The internal combustion engine of claim 12, wherein said control apparatus includes a memory storing a computer program for carrying out a method for operating an internal combustion engine wherein fuel reaches a combustion chamber of said engine via a fuel injection device which includes a piezo actuator operating over a running or operating time (t) and for which a drive energy (U) is required for a specific stroke (h), the method comprising the steps of:

determining a function which couples said stroke (h), said drive energy (U) and said operating time (t) for a typical collective load (L1, L2) to which a piezo actuator can be subjected; and, utilizing said function to determine said required drive energy (U) for said specific stroke (h).

* * * * *